United States Patent [19]

Ruge et al.

[11] Patent Number: 4,887,528

[45] Date of Patent: Dec. 19, 1989

[54] DAMPENING SYSTEM ROLLER FOR OFFSET PRINTING PRESSES

[75] Inventors: Arthur A. Ruge, Stone Mountain; Donald A. Kenagy, Atlanta, both of Ga.

[73] Assignee: Ceradyne, Inc., Costa Mesa, Calif.

[21] Appl. No.: 264,374

[22] Filed: Oct. 31, 1988

[51] Int. Cl.[4] ..... B41L 23/04; B41L 25/02

[52] U.S. Cl. ..... 101/148; 29/132; 29/458; 29/469.5; 29/527.2; 156/256; 156/257; 156/294; 427/387; 428/446; 428/447; 428/906

[58] Field of Search ..... 101/148, 348, 350, 355, 101/367, 483; 29/110, 115, 121.1, 121.8, 123, 132, DIG. 39, 458, 469.5, 527.2; 427/387; 428/446, 447, 906; 156/294, 256, 257

[56] References Cited

U.S. PATENT DOCUMENTS

| | | | |
|---|---|---|---|
| 4,167,351 | 9/1979 | Bindin | 29/458 X |
| 4,230,475 | 10/1980 | Dunk | 29/115 X |
| 4,396,445 | 8/1983 | Sasaki et al. | 156/294 X |
| 4,399,598 | 8/1983 | Page et al. | 29/115 |
| 4,429,003 | 1/1984 | Fredriksson et al. | 428/446 X |
| 4,542,073 | 9/1985 | Tanaka et al. | 428/446 |
| 4,697,325 | 10/1987 | Kamigaito et al. | 29/458 X |
| 4,759,284 | 7/1988 | Haggard et al. | 101/148 |
| 4,777,087 | 10/1988 | Heeks et al. | 29/132 X |
| 4,794,680 | 0/1989 | Meyerhoff et al. | 29/132 |

*Primary Examiner*—Edgar S. Burr
*Assistant Examiner*—Moshe I. Cohen
*Attorney, Agent, or Firm*—Leonard Tachner

[57] ABSTRACT

A dampening system roll which may be used in an offset printing press, is made of porous rebonded, fused silica, the pores of which are impregnated and sealed by a silicone resin. In a typical embodiment of the invention disclosed herein, a dampening system roll is fabricated by providing a 3 ¾ inch diameter 42 ½ inch long fused silica cylinder infiltrated with a silicone resin and ground and polished to a 30 microinch Ra exterior smoothness. The ends of the cylinder are drilled out to provide a 1 ¾ inch diameter by 4 inch deep hollow core on each side which is adapted to receive a pair of shafts or end caps typically made of stainless steel or other low expansion metal alloy material and the end shafts or caps are bonded into the drilled ends of the fused silica cylinder for interfacing the printing press system. In an additional embodiment, the ends of the cylinder are core drilled to provide a pair of axial sockets each about 2 inches in diameter and about 2 inches deep. A threaded, low expansion metal alloy insert is then bonded to the interior of each such socket and mating threaded shafts are screwed into the inserts for connecting the cylinder to the remainder of the dampening system.

5 Claims, 2 Drawing Sheets

DAMPENING SYSTEM ROLLER FOR OFFSET PRINTING PRESSES

BACKGROUND OF THE INVENTION

FIELD OF THE INVENTION

The present invention relates generally to dampening system rollers used in offset printing presses to provide water to the plate cylinder and prevent ink feedback on adjacent water rollers and more specifically, to a dampening roller comprising rebonded fused silica having pores impregnated and sealed with a silicone resin.

PRIOR ART

In a continuous dampening system of an offset printing press, the dampening roller picks up an even film of water and frictionally engages the water roller for the purpose of transferring the water to the plate cylinder and to preclude ink feedback on the water rollers. The amount of water carried by the dampening roller and delivered to the plate cylinder is a critical parameter of an offset printing press. If the dampening roller does not pick up a sufficiently even, flat film of water, ink builds up on the water rollers, requiring that the offset printing press be shut down to permit manual cleaning of the inking roller and plate cylinder which is, of course, a costly and time consuming process. On the other hand, if too much water is delivered by the dampening roller to the plate cylinder, the excess water dilutes the ink on the plate cylinder, reducing its efficiency and interfering with the performance of the printing press. Dampening system rollers currently in use are typically made of steel and have surface which are either chromium plated or flame sprayed with a metal oxide, such as aluminum oxide. Unfortunately, such prior arts rolls tend to corrode and contribute to ink buildup on the water rollers. Furthermore, they are relatively heavy, requiring commensurately larger motors for operation. There is, therefore, a current need for an offset printing press dampening system roll which resists corrosion, is more efficient at picking up water, which does not permit ink buildup and therefore does not have to be cleaned often and which is much lighter than current rolls to reduce the wear on motors and gears and in fact permit the reduction in the size of motors used in conjunction with such rolls.

SUMMARY OF THE INVENTION

The present invention satisfies the aforementioned needs of a dampening roll used in an offset printing press. It comprises a dampening roll which is made of porous rebonded fused silica, the pores of which are impregnated and sealed by a silicone resin. Fused silica rolls do not corrode, do not contribute to ink buildup and are lighter, therefore requiring smaller motors for operation or alternatively reducing the load on existing larger motors, thereby increasing reliability. Furthermore, the present invention picks up a more even film of water and such improved water pick-up performance appears to reduce or entirely eliminate the need for periodic cleaning.

In a typical embodiment of the invention shown herein, a dampening roll is fabricated by providing a 3¾ inch diameter 42½ inch long porous rebonded fused silica cylinder infiltrated with a silicone resin and ground and polished to a 30 microinch Ra exterior smoothness. The ends of the cylinder are then drilled out to provide about 2 inch diameter hollow core on each side which are adapted to receive a pair of inserts typically made of stainless steel or other low expansion metal alloy material and shafts are then threaded inter the inserts. The shape of the shafts, as well as the overall dimensions of the roller, including the shafts and the fused silica cylinder, are, of course, a matter of design choice and are therefore not to be considered limiting of the present invention. The term "dampening system roll", as used herein, refers to any of the rolls used in either contact or non-contacting offset dampening systems for transferring a constant regulated amount of moisture to the offset printing plate. Furthermore, as used herein the term "solid" means "entirely". Thus a solid fused silica cylinder is made entirely of fused silica, but may still be porous to receive an impregnant as described herein.

OBJECTS OF THE INVENTION

It is therefore a principal object of the present invention to provide an improved dampening system roll for the continuous dampening system of an offset printing press wherein the roll comprises a cylinder made entirely of fused silica which is impregnated and sealed by a silicone resin resulting in a dampening roll which is resistant to corrosion, is of lighter weight and is a more efficient carrier of water to the plate cylinder of the printing press.

It is still an additional object of the present invention to provide an improved dampening system roll for a continuous dampening system in an offset printing press wherein the dampening system rolls comprise impregnated porous ceramic material for improving the reliability and performance of the dampening system.

It is an additional object of the present invention to provide a continuous dampening system for an offset printing press in which the dampening system rolls are made of a solid ceramic material such as fused silica, which is impregnated and sealed by a silicone resin, thereby reducing the weight of conventional dampening rolls, making it possible to either decrease the size of motors used to rotate the rolls or to increase the life of conventional motors normally used with heavier rolls.

BRIEF DESCRIPTION OF THE DRAWINGS

The aforementioned objects and advantages of the present invention as well as additional objects and advantages thereof will be more fully understood thereafter as a result of a detailed description of a preferred embodiment when taken in conjunction with the following figures.

DETAILED DESCRIPTION OF PREFERRED EMBODIMENTS

Figure 1:
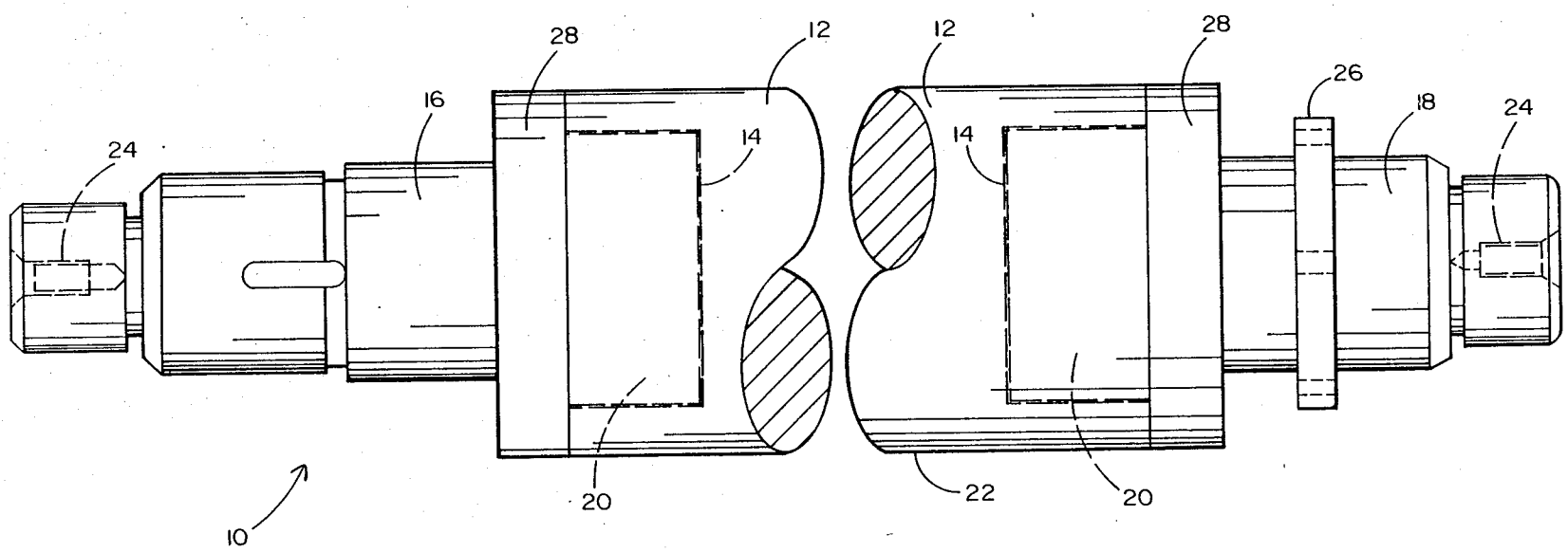
FIG. 1 is an elevational view of a first embodiment of the invention.
Figure 2:
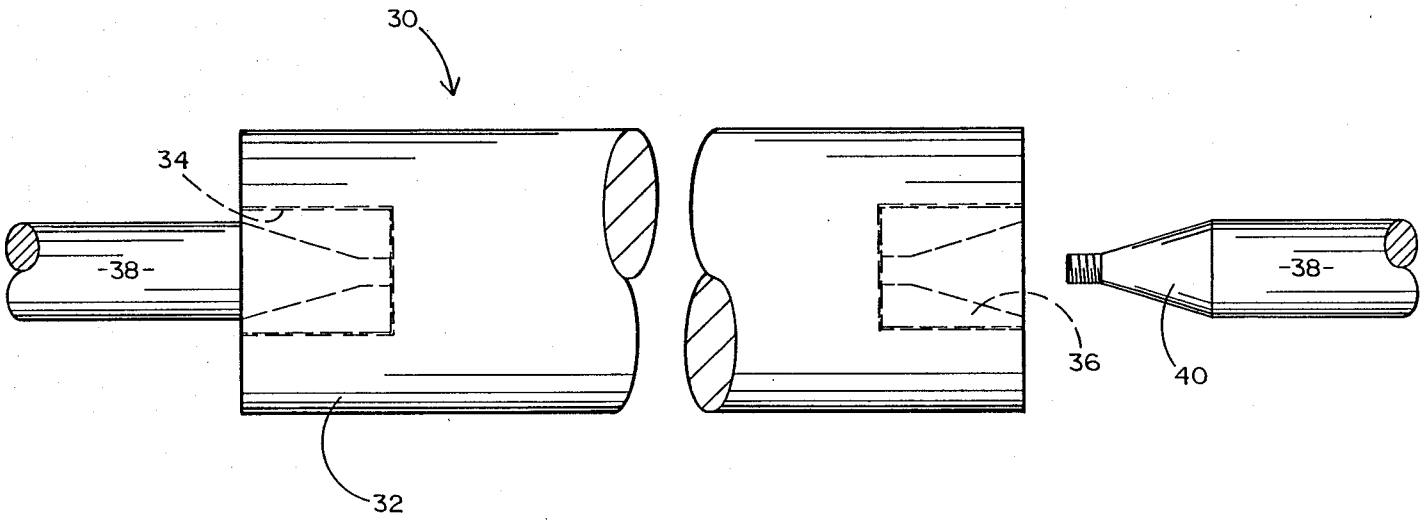
FIG. 2 is an elevational view of a second embodiment of the invention.

Referring now to FIG. 1 it will be seen that in a first embodiment, the dampening system roller 10 of the present invention comprises an elongated fused silica roll or cylinder 12 having a pair of recesses 14 in the ends thereof. The recesses are adapted to receive a first end member 16 and a second end member 18. Each end member terminates at one end in a plug 20 which is designed to be received in press fit engagement with the corresponding recess 14. In a preferred embodiment of the invention, an epoxy bonding compound such as Magnolia plastics epoxy resin 6388-3 is coated onto the respective interfacing surfaces of each plug 20 and its corresponding recess 14 and allowed to cure to provide secure bonding engagement between the plugs 20 and the recesses 14. The first and second end members, 16 and 18 respectively, are of conventional design in all other respects in that they are shaped identically to the end portions of a conventional dampening system roll such as one made of steel and having a chrome-plated or flame-sprayed surface as previously described. However, for purposes of providing a complete disclosure it should be noted that each end member is provided with a guide pin receptacle 24 for accurately turning roll 12 along a straight and true axis when installed in the offset printing press. Furthermore each end member may be provided with a shaft or roll cap 28 which is secured to the ends of the fused silica roll 12 when the plugs 20 are secured within their respective recesses 14.

In a second embodiment of the invention, the roller 30 comprises a solid fused silica roll 32 into which axial sockets 34 are coredrilled at the ends. A partial threaded, low expansion metal alloy insert 36 is then bonded into each such socket. A mating shaft 38 having a matched threaded nose portion 40 is then secured to each insert to provide the mechanical interface for the roller 30.

The pores of the fused silica roll in either embodiment are filled with a silicone resin impregnant which is designed to reduce the inherent porosity of the fused silica roll and to improve the overall water pickup performance of the roll. In a preferred embodiment of the invention, fused silica roll blanks are rough ground to approximately 100 microinch Ra surface roughness and then impregnated throughout with a silicone resin such as GE model SR80M silicone resin. After curing, any excess resin is removed and the surface of the roll is polished to an approximately 30 microinch Ra surface roughness.

It will now be understood that what has been disclosed herein, comprises a novel dampening system roller for a continuous dampening system of an offset printing press. The dampening system roller of the invention comprises a fused silica cylinder, which is impregnated and sealed by a silicone resin and then polished to approximately 30 microinch Ra surface roughness. In a preferred embodiment of the invention disclosed herein, the ends of the fused silica roll are provided with recesses adapted to receive inserts of integral first and second end members which provide the appropriate interface for placement of the dampening roller within the offset printing press. The end members may be made of a metal alloy material such as steel and the like which is selected to exhibit low expansion characteristics.

Those having skill in the art to which the present invention pertains will now, as a result of applicant's teaching herein, perceive various modifications and additions which may be made to the invention. By way of example, while the present invention has been described as comprising a fused silica roll, it will now be apparent that other ceramic materials may also be appropriate for use in dampening system rollers of offset printing presses and the like. Furthermore, while particular shapes and dimensions have been disclosed for the roller and the aforementioned recesses, it will be understood that all such shapes and dimensions may be readily altered to accommodate the physical requirements for interfacing a dampening system roller into an existing or newly manufactured offset printing press having a continuous dampening system of the type herein described. Accordingly, all such modifications and additions are deemed to be within the scope of the invention which is to be limited only by the claims appended hereto.

We claim:

1. An improved dampening system roller of the type used in an offset printing press for picking up a film of water and transferring it to the plate cylinder; the improvement comprising:

a solid cylinder made of fused silica and having recesses in the axial ends thereof, said fused silica being impregnated throughout its entire volume by a silicone resin; and a pair of end member inserts bonded to said cylinder recesses for connecting said roller in said press.

2. The improvement recited in claim 1 further comprising a shaft of cylindrical shape having an exterior diameter substantially equal to the exterior diameter of said inserts, the shafts forming the axial ends of said cylinder for connecting the roller in said press.

3. The improvement recited in claim 1 wherein the silicon resin sealed exterior radial surface of said cylinder has a surface roughness of no more than 30 microinches Ra.

4. An improved dampening system roller of the type used in an offset printing press for transferring a constant regulated amount of moisture to the offset plate cylinder; the improvement comprising;

a porous cylinder made entirely of fused silica and being filled throughout its entire porous volume with silicone resin.

5. A method of manufacturing a dampening system roller of the type used in an offset printing press for transferring a constant regulated amount of moisture to the offset printing plate; the method comprising the steps of:

(a) fabricating a porous solid ceramic cylinder of selected dimensions;

(b) rough grinding said cylinder to a surface roughness of nor more than approximately 100 microinches Ra;

(c) filling the porous volume of said cylinder with a curable impregnant;

(d) curing said impregnant;

(e) polishing the radial surface of said cylinder to a surface roughness of no more than approximately 30 microinches Ra;

(f) drilling a socket in each axial end of said cylinder;

(g) bonding a threaded low expansion material insert into each said socket; and (h) threading a longitudinal shaft into each of said inserts.

* * * * *